US006194819B1

(12) United States Patent
Codina et al.

(10) Patent No.: US 6,194,819 B1
(45) Date of Patent: Feb. 27, 2001

(54) SPARK PLUG WITH LOWER OPERATING TEMPERATURE

(75) Inventors: George Codina, N. Hollywood, CA (US); Lonnie D. Atteberry, Peoria Heights, IL (US); Steven Yap, Dunlap, IL (US); Donald R. Krull, Galesburg, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/112,891

(22) Filed: Jul. 9, 1998

Related U.S. Application Data

(63) Continuation-in-part of application No. 08/987,666, filed on Dec. 9, 1997, now abandoned.

(51) Int. Cl.[7] ..... H01T 13/16
(52) U.S. Cl. ..... 313/141; 313/133; 313/143
(58) Field of Search ..... 313/141, 143, 313/123, 133

(56) References Cited

U.S. PATENT DOCUMENTS

| | | | | |
|---|---|---|---|---|
| 1,254,449 | * | 1/1918 | Thomas | 313/143 |
| 2,479,577 | | 8/1949 | Lang . | |
| 3,743,877 | | 7/1973 | Strumbos | 313/11.5 |
| 4,110,667 | | 8/1978 | Graf Vom Hagen | 313/143 |
| 4,491,101 | | 1/1985 | Strumbos | 123/169 |
| 4,810,929 | | 3/1989 | Strumbos | 313/11.5 |
| 4,841,925 | * | 6/1989 | Ward | 313/143 |
| 5,128,583 | | 7/1992 | Ma | 313/137 |
| 5,564,403 | | 10/1996 | Codina et al. | 123/653 |
| 5,590,629 | | 1/1997 | Codina et al. | 123/310 |
| 5,831,377 | * | 11/1998 | Matsubara et al. | 313/143 |

FOREIGN PATENT DOCUMENTS

| | | | |
|---|---|---|---|
| 0171153A1 | 2/1986 | (EP) | H01T/13/34 |
| 385208 | 5/1932 | (GB) . | |
| 536460 | 12/1939 | (GB) . | |
| 906620 | 5/1960 | (GB) . | |
| WO9700547 | 1/1997 | (WO) | H01T/1/24 |

* cited by examiner

*Primary Examiner*—Ashok Patel
(74) *Attorney, Agent, or Firm*—Calvin E. Glastetter

(57) ABSTRACT

A spark plug with lower operating temperature has an electrode with a tip which evenly distributes heat imparted to the firing end portion of the spark plug. The electrical insulating material surrounding the electrode is spaced at a predetermined distance from the firing end portion of the spark plug to allow the heat to more quickly travel away from the firing end portion. An annular groove in the first end surface of the electrical insulating material minimizes electrical surface discharge between the electrode and the annular metal shell of the spark plug. Radii at locations of change in cross-section in the bore of the annular metal shell and the electrical insulating material serve to minimize voltage breakdown.

11 Claims, 3 Drawing Sheets

SPARK PLUG WITH LOWER OPERATING TEMPERATURE

This application is a continuation-in-part of application Ser. No. 08/987,666 filed, Dec. 9, 1997, now abandoned.

TECHNICAL FIELD

This invention relates generally to a spark plug and more particularly to a spark plug that operates at lower temperatures than conventional spark plugs.

BACKGROUND ART

Spark plugs that operate at high temperatures are commonly referred to as "hot plugs". Hot plugs have a tendency to pre-ignite the fuel mixture in the combustion zone. Pre-ignition of the fuel mixture in the combustion zone, also known as engine knock, reduces engine performance and in some instances, causes damage to the engine.

Another drawback to hot plugs is that deposits from fuel and lubricant additives which haven't burned away, are melted by the hot plug to form a glaze which coats the nose portion of the plug insulator. When the glaze on the nose portion of the plug insulator gets hot, the plug is shorted out and engine misfire occurs. Engine misfire is accompanied by fuel and power loss.

The main reason spark plugs operate at high temperatures is that the ceramic insulator surrounding the center electrode becomes hot due to combustion gas temperatures. Further, ceramic materials are normally poor conductors of heat.

Various devices for removing heat from the firing end of a spark plug have been used. One such heat removal device is a heat pipe having a vaporizable medium. Heat at the firing end of the spark plug is absorbed by the vaporizable medium causing such medium to convert to a vapor. The change of state of the vaporizable medium extracts heat from the firing end of the plug. The vaporized medium moves to a cooler part of the heat pipe where it condenses and releases heat through another change of state. The use of a heat pipe is an added expense and is a less than desirable heat removal method for use in the market place.

Another device for removing heat from the firing end of a spark plug is a thermally conductive filler composition introduced between the center electrode and the spark plug insulator. Some of the thermally conductive filler compositions in use include silver, cermet, talc, and silicon. Filler materials serve as a seal between the electrode and the insulator but only provide moderate improvement in thermal conductivity.

The present invention is directed to overcoming one or more of the problems as set forth above.

DISCLOSURE OF THE INVENTION

In the present invention, a spark plug has a terminal end portion and a firing end portion disposed along a longitudinal axis. An annular metal shell is disposed about and along the longitudinal axis and has external threads located along the firing end portion. A firing end surface is located adjacent the external threads. A bore is defined within the annular metal shell and about the longitudinal axis. An electrical insulating material is received in the bore of the annular metal shell and is disposed along the longitudinal axis. The electrical insulating material has a first end surface facing the firing end portion and a second end surface facing the terminal end portion of the spark plug. The first end surface has at least one annular groove defined therein and about the longitudinal axis. An inner bore is defined within the electrical insulating material and about the longitudinal axis. An electrode is received in the inner bore of the electrical insulating material. The electrode extends along the longitudinal axis and is connected at a first end to the terminal end portion. The electrode has a second end terminating at the firing end portion.

BEST MODE FOR CARRYING OUT THE INVENTION

Figure 1:
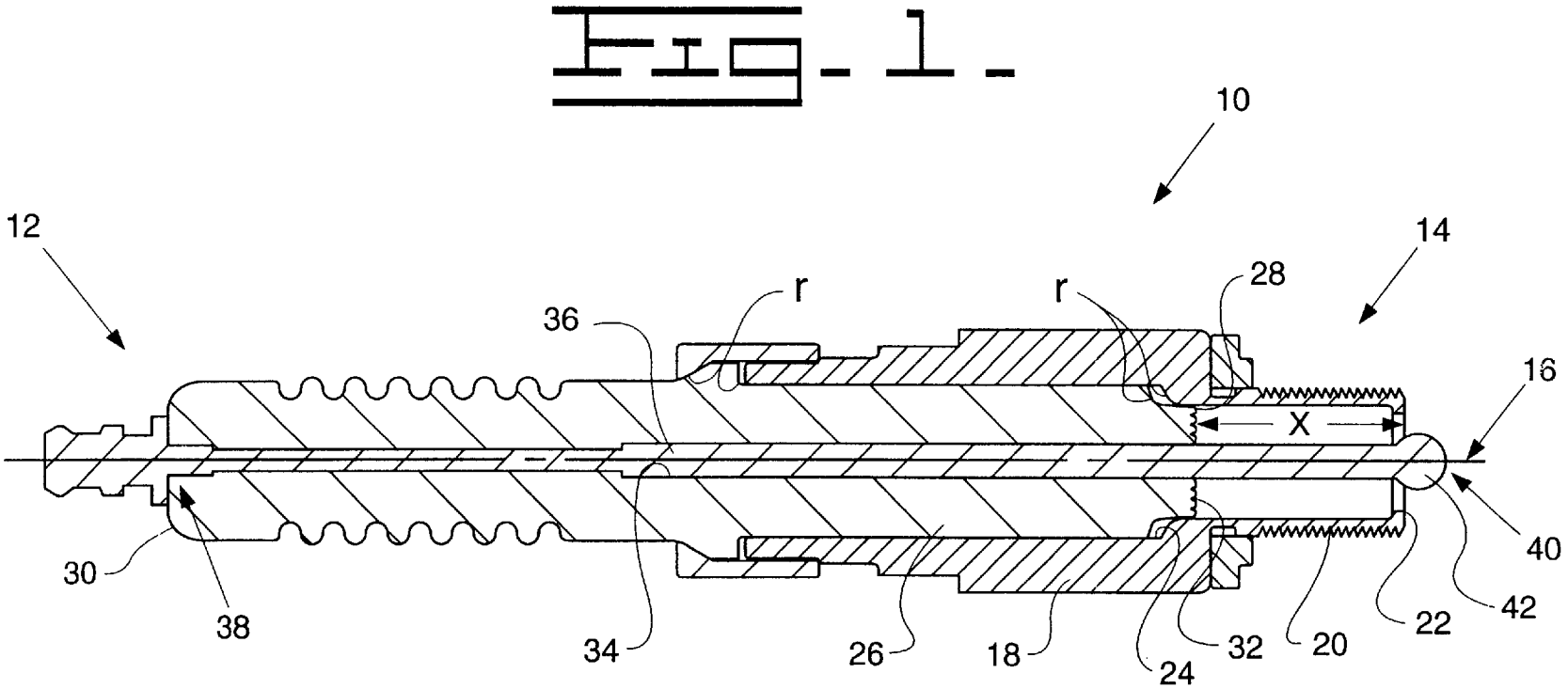
FIG. 1 is a diagrammatic cross-sectional view of the present invention.

Referring to FIG. 1, a spark plug 10 has a terminal end portion 12 and a firing end portion 14 disposed along a longitudinal axis 16. An annular metal shell 18 is disposed about and along the longitudinal axis 16. The annular metal shell 18 has external threads 20 located along the firing end portion 14. A firing end surface 22 is located adjacent the external threads 20, and a bore 24 is defined within the annular metal shell 18 about the longitudinal axis 16.

An electrical insulating material 26 is received in the bore 24 of the annular metal shell 18. The electrical insulating material 26 is disposed along the longitudinal axis 16 between the terminal end portion 12 and the firing end portion 14. The electrical insulating material 26 has a first end surface 28 facing the firing end portion 14 and a second end surface 30 facing the terminal end portion 12 of the spark plug 10.

Figure 2:
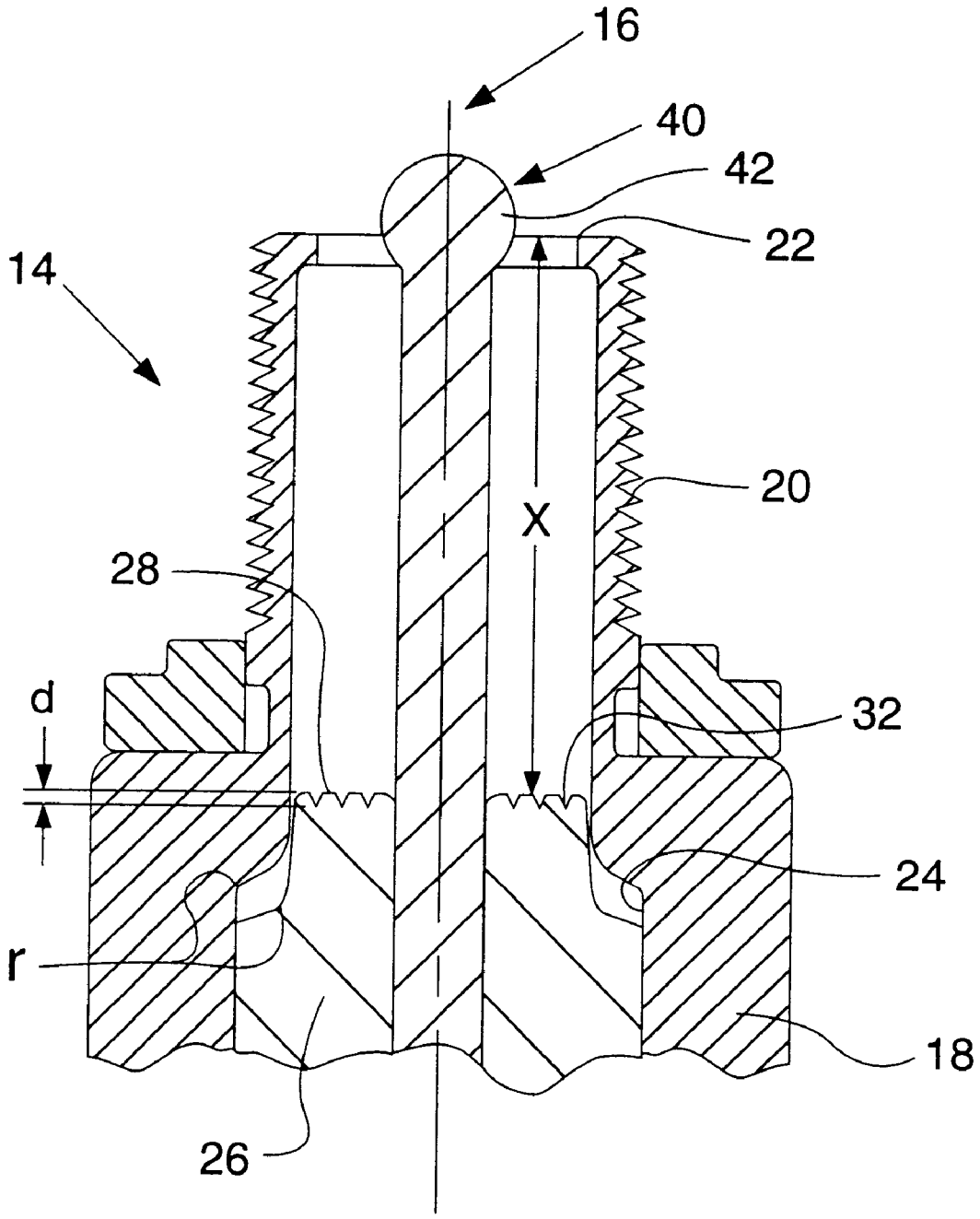
FIG. 2 is an enlarged diagrammatic cross-sectional view of a portion of FIG. 1.

Referring to FIG. 2, the first end surface 28 of the electrical insulating material 26 has at least one annular groove 32 defined therein and about the longitudinal axis 16. The annular groove 32 has a predetermined depth "d" defined in the first end surface 28. More specifically, the predetermined depth "d" of the annular groove 32 has a nominal depth of about 1 mm.

The annular groove 32 serves to minimize the occurrence of electrical surface discharge. Electrical surface discharge occurs when current "migrates" across a surface that lies between a voltage source and ground. The annular groove 32 defined in the first end surface 28 of the electrical insulating material 26 serves to increase the path that current must travel across, and ultimately minimizes the occurrence of electrical surface discharge.

As best shown in FIG. 1, an inner bore 34 is defined within the electrical insulating material 26. The inner bore 34 is defined about the longitudinal axis 16.

An electrode 36 is received in the inner bore 34 of the electrical insulating material 26. The electrode 36 extends along the longitudinal axis 16 and is connected at a first end 38 to the terminal end portion 12. The electrode 36 has a second end 40 which terminates at the firing end portion 14.

The second end 40 of the electrode 36 has a generally rounded tip, for example spherical, 42 adjacent the firing end portion 14 of the spark plug 10. The rounded shape of the tip 42 facilitates even heat distribution which is one reason the spark plug 10 of this invention operates at a lower temperature. It is recognized that the tip 42 can have a geometry other than rounded so long as sharp edges are eliminated. Sharp edges act as a heat sink and ultimately contribute to a spark plug that operates at a hotter temperature. An example of other geometries suitable for the tip 42 include but are not limited to elliptical, oval, arcuate and other generally smooth shaped geometries.

The first end surface 28 of the electrical insulating material 26 is spaced at a predetermined distance "x" from the firing end surface 22 of the spark plug 10. More specifically, the predetermined distance "x" is in the range of about 15 mm to about 40 mm and preferably about 32 mm. It is desirable to have the spacing of the electrical insulating material 26 at the predetermined distance "x" from the firing end surface 22 for the purpose of allowing the spark plug 10 of this invention to operate at a lower temperature. This construction allows heat to travel away from the firing end 14 instead of being held in by the electrical insulating material 26.

If the predetermined distance "x" is less than the lower limit of about 15 mm of the above stated range, the electrical insulating material 26 surrounding the electrode 36, extends nearer to the firing end portion 14. If the electrical insulating material 26 surrounding the electrode 36 is extended nearer to the firing end portion 14, heat is more readily trapped in that portion of the electrode 36 which ultimately causes the spark plug 10 to operate at a higher temperature.

If the predetermined distance "x" is greater than the upper limit of about 40 mm of the above stated range, the electrical insulating material 26 surrounds an even smaller portion the electrode 36, but does not provide any appreciable advantage in removing heat from the firing end portion 14 of the spark plug 10.

At locations of change in cross-section in the bore 24 of the annular metal shell 18 and the received electrical insulating material 26, radii "r" have been applied. More specifically, the radii "r" have a nominal radius of about 0.5 mm. The radii "r" at locations of change in cross-section serve to minimize voltage breakdown in those areas. Voltage breakdown occurs when current suddenly passes in destructive amounts through a dielectric, such as the electrical insulating material 26. The radii "r" eliminate sharp edges and correspondingly minimize voltage breakdown.

Figure 3:
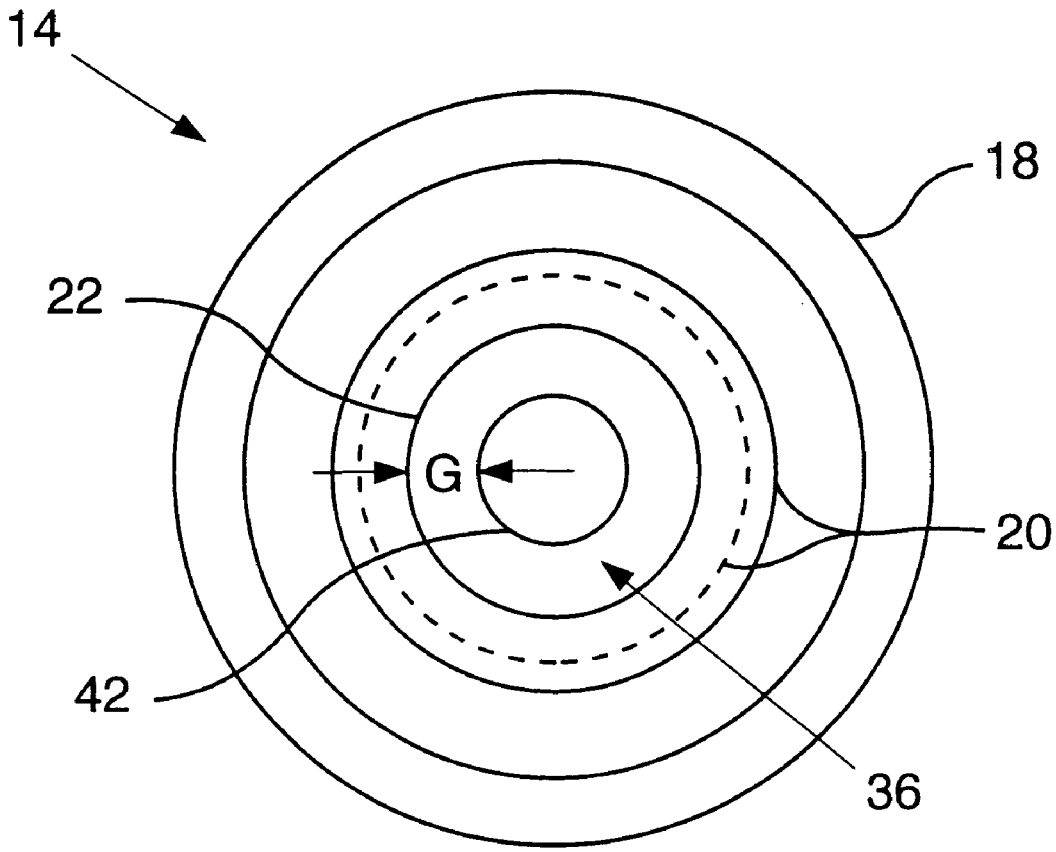
FIG. 3 is a diagrammatic top view of the invention as shown in FIGS. 1 and 2.

Referring to FIG. 3, a spark gap "G" is defined at the firing end portion 14 between the firing end surface 22 and the tip 42 of the electrode 36. The spark gap "G" has a predetermined dimension in the range of about 0.5 mm to about 5 mm and preferably about 1 mm to about 1.5 mm.

If the spark gap "G" is less than the lower limit of about 0.5 mm of the above stated range, a lower electrical energy potential exists across the spark gap "G". A lower electrical energy potential across the spark gap "G" results in a less powerful spark arcing across the spark gap "G". A less powerful spark arcing across the spark gap "G" is undesirable because optimum combustion is not achieved. Additionally, if the spark gap "G" is less than the lower limit of about 0.5 mm as stated above, the firing end surface 22 and the tip 42 of the electrode 36 are physically very close together which results in a localized build-up of heat that accelerates erosion of the tip 42 and/or the firing end surface 22.

If the spark gap "G" is greater than the upper limit of about 5 mm of the above stated range, the voltage required to cause a spark to arc across the spark gap "G" becomes impractical. More specifically, a spark gap "G" greater than about 5 mm, when operating at high loads, high pressures and high compression, requires a voltage of about 50 to 60 kV to cause a spark to arc across the spark gap "G". The higher voltage requirement of about 50 to 60 kV is impractical in relation to the voltage breakdown characteristics of the present components. In addition to the high voltage required to cause a spark to arc across a spark gap that is greater than the upper limit of about 5 mm, the physical overall dimension of a typical spark plug prohibits a spark gap greater than about 5 mm. Essentially, there is no room to increase the spark gap "G" greater than about 5 mm without changing the overall dimension of the spark plug.

The spark gap "G" as defined above is desired for optimized power and practicality.

Industrial Applicability

The spark plug 10 of this invention is adapted for use with an internal combustion engine, not shown, and utilizes a voltage source, also not shown. The spark plug 10, via the external threads 20, is threadably engaged with the engine as is well known in the art.

At the appropriate time, the voltage source applies a voltage to the terminal end portion 12 of the spark plug 10. The applied voltage to the terminal end portion 12 appears at the firing end portion 14 through electrode 36. The applied voltage, then arcs across the spark gap "G" in the form of a spark, between the firing end surface 22 and tip 42 of the electrode 36. This spark and its shockwave initiate the combustion process in the engine.

Heat from the combustion process is imparted into the firing end portion 14 of the spark plug 10 and more specifically, into the electrode 36. The rounded tip 42 of the electrode 36 facilitates an even distribution of the heat imparted by the combustion process. Additionally, the rounded tip 42 eliminates sharp edges where heat retention typically occurs, and substantially reduces the potential for engine pre-ignition.

The electrical insulating material 26, being spaced at the predetermined distance "x" from the firing end surface 22, allows the heat imparted into the electrode 36 to travel away at a much faster rate from the firing end portion 14 than conventional spark plug designs. The travel of heat away from the firing end portion 14 causes the spark plug 10 to operate at a lower temperature.

The annular groove 32 in the first end surface 28 of the electrical insulating material 26 minimizes the occurrence of electrical surface discharge. The annular groove 32 increases the path that the electrical current must travel if the current attempted to "migrate" across the first end surface 28 between the electrode 36 and the annular metal shell 18. The annular groove 32 not only minimizes electrical surface discharge but also allows the electrical insulating material 26 to be spaced at the predetermined distance "x" from the firing end portion 14. The net result is that the spark gap "G" favors electrical discharge rather than the path across the first end surface 28 of the electrical insulating material 26.

The radii "r" at locations of change in cross-section in the bore 24 of the annular metal shell 18 and the received electrical insulating material 26, minimize voltage breakdown by eliminating sharp edges.

In view of the foregoing, it is readily apparent that the structure of the present invention provides a spark plug 10 that operates at lower temperatures.

Other aspects, objects and advantages of this invention can be obtained from a study of the drawings, the disclosure and the appended claims.

What is claimed is:

1. A spark plug comprising:

a terminal end portion and a firing end portion disposed along a longitudinal axis;

an annular metal shell disposed about and along the longitudinal axis and having external threads located along the firing end portion, a firing end surface located adjacent the external threads, and a bore defined within the annular metal shell and about the longitudinal axis;

an electrical insulating material received in the bore of the annular metal shell and disposed along the longitudinal axis between the terminal end portion and the firing end portion, the electrical insulating material having a first end surface facing the firing end portion and a second end surface facing the terminal end portion of the spark plug, the first end surface having at least one annular groove defined therein and about the longitudinal axis, and an inner bore defined within the electrical insulating material and about the longitudinal axis; and an electrode received in the inner bore of the electrical insulating material, the electrode extending along the longitudinal axis and being connected at a first end to the terminal end portion and having a second end terminating at the firing end portion.

2. The spark plug as set forth in claim 1 wherein the second end of the electrode has a generally rounded tip adjacent the firing end portion of the spark plug.

3. The spark plug as set forth in claim 1 wherein the first end surface of the electrical insulating material is spaced a predetermined distance from the firing end surface.

4. The spark plug as set forth in claim 3 wherein the predetermined distance is in the range of about 15 mm to about 40 mm and preferably about 32 mm.

5. The spark plug as set forth in claim 1 wherein the bore of the annular metal shell and the received electrical insulating material have radii at locations of change in cross-section.

6. The spark plug as set forth in claim 5 wherein the radii at locations of change in cross-section have a nominal radius of 0.5 mm.

7. The spark plug as set forth in claim 1 wherein the annular groove defined in the first end surface of the electrical insulating material facing the firing end portion of the spark plug has a predetermined depth.

8. The spark plug as set forth in claim 7 wherein the predetermined depth of the annular groove has a nominal depth of about 1 mm.

9. The spark plug as set forth in claim 1 wherein a spark gap is defined at the firing end portion, between the firing end surface and the tip of the electrode.

10. The spark plug as set forth in claim 9 wherein the spark gap has a predetermined dimension.

11. The spark plug as set forth in claim 10 wherein the predetermined dimension of the spark gap is in the range of about 0.5 mm to about 5 mm and preferably about 1 mm to about 1.5 mm.

* * * * *